US005980143A

United States Patent [19]

Bayer et al.

[11] Patent Number: 5,980,143

[45] Date of Patent: Nov. 9, 1999

[54] WRIST REST ASSEMBLY

[75] Inventors: Glen H. Bayer, Cottage Grove; Larry A. Bettenhausen, Lakeland, both of Minn.

[73] Assignee: Minnesota Mining and Manufacturing Company, St. Paul, Minn.

[21] Appl. No.: 08/704,332

[22] Filed: Aug. 28, 1996

[51] Int. Cl.[6] ..... B41J 29/00

[52] U.S. Cl. ..... 400/715; 400/719; 248/118.1

[58] Field of Search ..... 400/715, 719; 248/118, 118.1, 118.5, 118.3

[56] References Cited

U.S. PATENT DOCUMENTS

| | | | |
|---|---|---|---|
| 793,756 | 7/1905 | Williams | 248/118.5 |
| 2,694,026 | 11/1954 | Johnson | 154/54 |
| 2,720,660 | 12/1955 | Smith | 5/338 |
| 3,676,387 | 7/1972 | Lindlof | 260/28.5 B |
| 3,858,379 | 1/1975 | Graves et al. | 53/25 |
| 4,043,330 | 8/1977 | Bansal | 128/133 |
| 4,456,642 | 6/1984 | Burgdörfer et al. | 428/68 |
| 4,481,556 | 11/1984 | Berke et al. | 361/222 |
| 4,482,063 | 11/1984 | Berke et al. | 211/69.1 |
| 4,482,064 | 11/1984 | Berke et al. | 211/69.1 |
| 4,545,554 | 10/1985 | Latino et al. | 248/118.1 |
| 4,621,781 | 11/1986 | Springer | 248/118 |
| 4,688,862 | 8/1987 | Fowler et al. | 312/325 |
| 4,842,931 | 6/1989 | Zook | 428/354 |
| 4,887,326 | 12/1989 | O'Brien et al. | 5/421 |
| 4,896,388 | 1/1990 | Bard | 5/441 |
| 4,913,390 | 4/1990 | Berke et al. | 248/176 |
| 4,973,176 | 11/1990 | Dietrich | 400/715 |
| 4,993,409 | 2/1991 | Grim | 128/78 |
| 5,020,852 | 6/1991 | Marion | 297/200 |
| 5,027,801 | 7/1991 | Grim | 128/80 |
| 5,050,826 | 9/1991 | Johnston | 248/80 |
| 5,082,720 | 1/1992 | Hayes | 428/224 |
| 5,121,962 | 6/1992 | Weber et al. | 208/214 |
| 5,125,606 | 6/1992 | Cassano et al. | 248/118 |
| 5,131,614 | 7/1992 | Garcia et al. | 248/118 |

(List continued on next page.)

FOREIGN PATENT DOCUMENTS

| | | |
|---|---|---|
| 1 268 431 | 3/1972 | United Kingdom . |
| Wo 95/33394 A | 12/1995 | WIPO . |

OTHER PUBLICATIONS

1994 Catalog, Bertelson Office Products, cover, pp. 440–442, 444, 445, 466.

1996 Catalog, Quill Corporation, cover, pp. XX, YY, 391–392, 396–398, 402–406.

(List continued on next page.)

*Primary Examiner*—Edgar S. Burr
*Assistant Examiner*—Anthony H. Nguyen
*Attorney, Agent, or Firm*—Carolyn V. Peters

[57] ABSTRACT

A wrist rest assembly has a base and a layer of resilient gel supported above the base. The wrist rest assembly is for use adjacent a device operated by a person's hands or fingers, such as a computer keyboard, lap-top or portable computer, computer mouse or other input device. A layer of resilient nonwoven material is disposed between the base and at least a portion of the layer of gel to define, in combination with the layer of gel, a resilient wrist rest support structure supported from the base. A flexible liquid-impervious layer is disposed between the layer of resilient gel and the layer of resilient nonwoven web material.

29 Claims, 3 Drawing Sheets

U.S. PATENT DOCUMENTS

| | | | |
|---|---|---|---|
| 5,158,255 | 10/1992 | Fuller | 248/118 |
| 5,163,646 | 11/1992 | Engelhardt | 248/118 |
| 5,170,971 | 12/1992 | Schaeffer et al. | 248/118 |
| 5,173,979 | 12/1992 | Nennhaus | 5/648 |
| 5,183,230 | 2/1993 | Walker et al. | 248/118 |
| 5,193,925 | 3/1993 | Foulke | 400/715 |
| 5,197,699 | 3/1993 | Smith et al. | 248/118 |
| 5,219,136 | 6/1993 | Hassel et al. | 248/118 |
| 5,228,655 | 7/1993 | Garcia et al. | 248/118 |
| 5,234,186 | 8/1993 | Powell | 248/118 |
| 5,242,139 | 9/1993 | Aldrich | 248/118 |
| 5,330,249 | 7/1994 | Weber et al. | 297/214 |
| 5,338,289 | 8/1994 | Cooker | 602/19 |
| 5,346,164 | 9/1994 | Allen | 248/118 |
| 5,348,408 | 9/1994 | Gelardi et al. | 400/715 |
| 5,356,099 | 10/1994 | Sereboff | 400/715 |
| 5,358,203 | 10/1994 | Smith et al. | 248/118 |
| 5,363,631 | 11/1994 | Garrison | 54/66 |
| 5,374,018 | 12/1994 | Daneshvar | 248/118 |
| 5,386,956 | 2/1995 | Hatcher | 248/118 |
| 5,407,156 | 4/1995 | Rossman et al. | 248/118.1 |
| 5,421,543 | 6/1995 | Rossman et al. | 248/118.3 |
| 5,435,508 | 7/1995 | Deuitch et al. | 248/118 |
| 5,443,237 | 8/1995 | Stadtmauer | 248/441.1 |
| 5,445,349 | 8/1995 | Hart | 248/118 |
| 5,445,858 | 8/1995 | Nwoko | 428/71 |
| 5,467,952 | 11/1995 | Martin | 248/118.1 |
| 5,470,036 | 11/1995 | Vu et al. | 248/118.5 |
| 5,475,882 | 12/1995 | Sereboff | 3/450 |
| 5,476,491 | 12/1995 | Mayn | 607/111 |
| 5,507,458 | 4/1996 | Campbell et al. | 248/118.3 |
| 5,513,400 | 5/1996 | Turner | 5/451 |
| 5,513,824 | 5/1996 | Leavitt et al. | 248/118.3 |
| 5,547,154 | 8/1996 | Kirchhoff et al. | 248/118.3 |
| 5,566,913 | 10/1996 | Prokop | 248/118 |
| 5,568,907 | 10/1996 | Wolfe et al. | 248/118 |
| 5,601,364 | 2/1997 | Peart | 248/118 |

OTHER PUBLICATIONS

Ergo Shop Catalog, a Division of NOVA International, Washington, D.C., cover, pp. 12–13 (published after Aug. 28, 1996).

WRIST REST ASSEMBLY

BACKGROUND OF THE INVENTION

This invention relates to a wrist rest assembly, and more specifically, to a lightweight, inexpensive and portable wrist rest assembly for use adjacent a device operated by a person's hands or fingers, such as a computer keyboard, lap-top or portable computer, computer mouse or other input device.

The growing use of computers and their associated input devices has led to a tremendous increase in Repetitive Stress Injuries among computer users. Examples of Repetitive Stress Injuries include aching hands, shoulders and neck, and particularly disorders relating to the wrists and hands, with the most common disorder being Carpal Tunnel Syndrome. Carpal Tunnel Syndrome is characterized by soreness, tenderness and weakness of the muscles of the thumb resulting from pressure on the median nerve at the point at which it goes through the carpal tunnel of the wrist. Carpal Tunnel Syndrome may result from long periods of repetitive motion with the hands and fingers, such as from manipulating a computer keyboard, lap-top or portable computer, computer mouse or other input device.

As the general public has become more aware of the dangers of Repetitive Stress Injuries, the demand for products that help to alleviate these disorders has grown rapidly. Thus, numerous arrangements have been proposed for supporting the hands and wrists while they are used to manipulate computer input devices, and for absorbing the vibrations which result from using such computer input devices. Such arrangements include vibration absorbing structures for supporting keyboards and the like, and cushioning support pads (e.g., foam or gel pads) for supporting a user's wrists or arms.

One such wrist support structure is the 3M Gel-Filled Adjustable Wrist Rest, commercially available from Minnesota Mining and Manufacturing Company, St. Paul, Minn. The 3M wrist rest has a rigid base assembly upon which is mounted an elongate wrist support pad. The pad is formed from a layer of resilient gel mounted on the base assembly and covered by a liquid impervious cover. The layer of gel in the pad helps maintain a user's wrists in a neutral position with a portion of the layer of gel conforming to the supported wrists to distribute the weight of the wrists over a wide area while affording significant motion of the wrists along the top surface of the elongate pad. The 3M Gel-Filled Wrist Rest is the subject of Kirchhoff et al. U.S. Pat. No. 5,547,154 (which is incorporated herein by reference). Although quite effective, the 3M wrist rest is not readily portable due to its weight (the gel material is rather dense) and rigid base configuration. Further, gel material is relatively expensive and the cost of the 3M wrist rest is thus prohibitive for a large segment of the market.

Other gel-based wrist rests are disclosed in U.S. Pat. No. 5,356,099 to Sereboff and U.S. Pat. No. 5,476,491 to Mayn. The Sereboff '099 patent discloses a wrist support system which has a liquid containing pack that is filled with either a liquid or a gel composition. The liquid containing pack is for resiliently supporting and conforming to the contours of the palm and wrist area when a user is operating a keyboard. The liquid containing pack is releasably fastenable to a base to form a reconfigurable wrist support system.

The Mayn '491 patent discloses a gel wrist support for computer users. The wrist support has a sealed, moisture proof envelope filled with gel and covered with a soft material. The wrist support is cooled in a freezer to serve as a therapeutic gel cold pack that is applied to the user's wrists during use (to cushion, absorb heat and reduce pain and inflammation).

Prior gel filled wrist rests have the severe drawback of a lack of portability due to their excessive weight. Users of multiple computers may desire to have a separate wrist rest for the input devices at each computer terminal. Additionally, users who travel with lap-top or portable computers also may also want to use a wrist rest. Further, the gel material used in such wrist rest structures is relatively expensive. Thus, many users cannot afford to purchase such wrist rests and forego the protection these structures provide.

SUMMARY OF THE INVENTION

The lightweight, inexpensive and portable wrist rest assembly of the present invention is for use adjacent a device operated by a person's hands or fingers, such as a computer keyboard, lap-top or portable computer, computer mouse or other input device. The wrist rest assembly has a base and a layer of resilient gel supported above the base. A layer of resilient material is preferably disposed between the base and at least a portion of the layer of gel to define, in combination with the layer of gel, a resilient wrist rest support structure supported from the base.

In a preferred embodiment, the gel is a stable elastomeric block copolymer gel. The layer of resilient material is selected from the group consisting of nonwoven or foam materials, or combinations thereof. A flexible, liquid impervious layer is disposed between the layer of resilient material and the layer of gel. The layer of resilient material has a lower density than the layer of gel. Preferably, the layer of gel is retained in a sealed chamber which is defined by a flexible upper wall, a lower wall and side walls disposed therebetween, with the layer of resilient material disposed in the chamber between its lower wall and the layer of gel.

BRIEF DESCRIPTION OF THE DRAWINGS

The present invention will be further explained with reference to the drawing figures listed below wherein like structure is referred to by like numerals throughout the several views.

While the above-identified drawings features set forth several preferred embodiments, other embodiments of the present invention are also contemplated, as noted in the discussion. This disclosure presents illustrative embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

Figure 1:
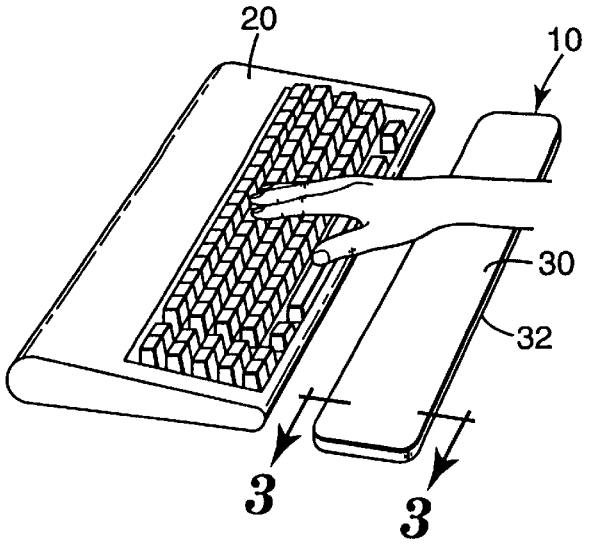
FIG. 1 is a perspective view of the lightweight, inexpensive and portable wrist rest assembly of the present invention shown adjacent a computer keyboard.
Figure 2:
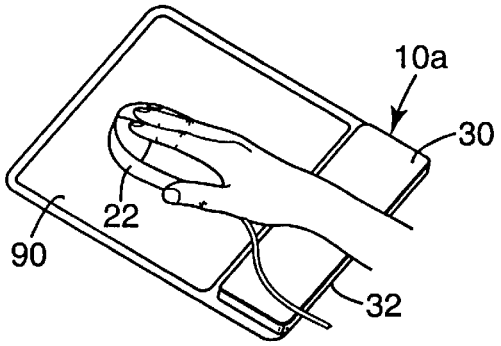
FIG. 2 perspective view of an alternative embodiment of the wrist rest assembly of the present invention shown with a computer mouse.

A lightweight, inexpensive and portable wrist rest assembly embodying the present invention is shown, by way of example, adjacent a computer keyboard 20 in FIG. 1, and adjacent a computer mouse 22 in FIG. 2. The wrist rest assembly (designated as 10 in FIG. 1 and as 10*a* in FIG. 2) is shown, in these two embodiments, as generally elongated. Alternative wrist rest assembly configurations, such as kidney-shaped, L-shaped or other angular configurations, are also contemplated. Preferably, the wrist rest assembly has a uniform height for supporting the wrist of a person using a computer input device, or other similar manually manipulated device. The exposed surfaces of the wrist rest assembly are comfortable to the touch, and the wrist rest assembly is designed to conform to and support a person's wrist, as shown.

Gel compositions have been found to be particularly suitable for use as the filler and compliant support material in wrist rests and other body support pads. Suitable gels are rather dense, however, and thus a typically sized wrist rest (approximately 3 inches wide, 19 inches long and ¾ inch thick) can be relatively heavy and cumbersome. The gel compositions suitable for wrist rests are also relatively expensive. Accordingly, the present invention is designed to achieve the conformity, feel and support of a gel-filled wrist rest while reducing the amount of gel required to achieve these ends, thereby reducing the cost of the final wrist rest assembly, as well as its weight.

Figure 3:
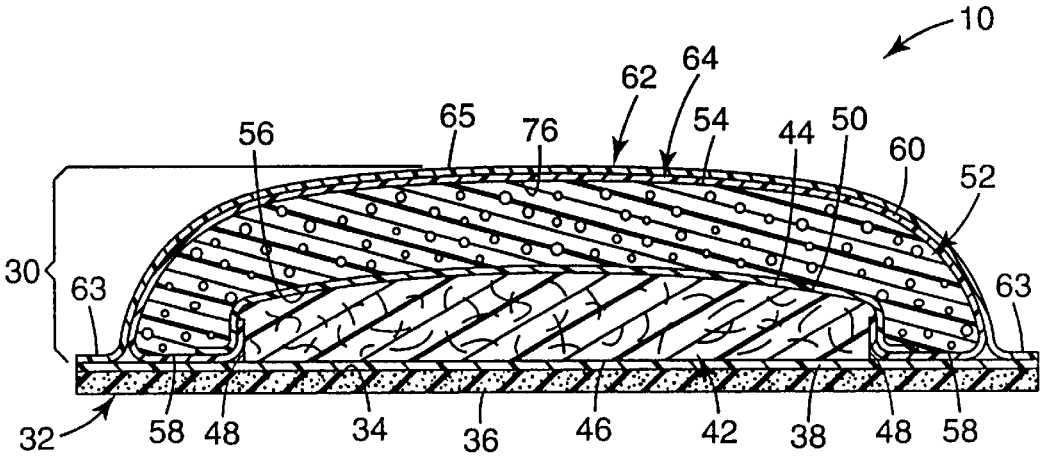
FIG. 3 is a sectional schematic view of the wrist rest assembly of the present invention taken along line 3—3 in FIG. 1.
Figure 4:
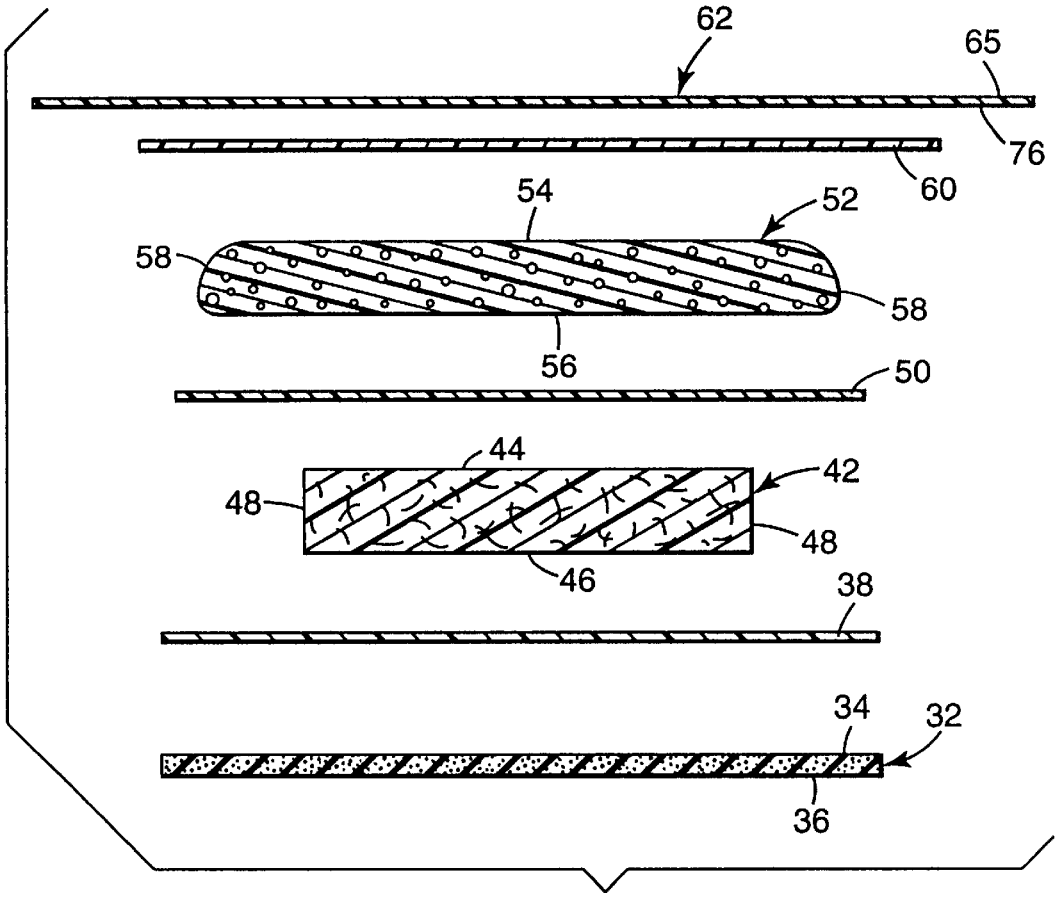
FIG. 4 is a sectional schematic view of the wrist rest assembly components, prior to assembly.

The components of a preferred embodiment of the inventive wrist rest assembly are illustrated in lateral section as assembled (FIG. 3) and unassembled (FIG. 4). The wrist rest assembly 10 generally includes an upper resilient section 30 attached to a lower supporting base 32. The base 32 is preferably planar and includes a top surface 34 and a bottom surface 36. A heat sealable film 38 is bonded to the top surface 34, and the bottom surface 36 has nonskid characteristics, either from the material of the base 32 itself, or from an additional layer of nonskid material coated or laminated to the bottom surface 36. The base 32 may be formed from a sheet of open-celled foam, close-celled foam or other suitable flexible material, or for some applications may even be formed as a rigid structure. In a preferred embodiment of the present invention, the base 32 is composed of a sheet of about ⅛ inch thick opened-celled rubber sponge No. 3110, commercially available from Griswold Rubber Co., Moosup, Conn. With this material no extra nonskid layer 38 need be applied, since the base material itself has nonskid material properties.

The upper resilient section 30 of the wrist rest assembly includes a layer of resilient material 42, a lower liquid-impervious layer 50, a layer of gel 52, an upper liquid-impervious layer 60 and an outer cover 62. The layer of resilient material 42 has a top surface 44, a bottom surface 46 and side edges 48 extending therebetween. The layer of gel 52 likewise has a top surface 54, a bottom surface 56 and side edges 58 extending therebetween. As discussed below (and illustrated in FIG. 3), the layer of resilient material 42 and the layer of gel 52 combine to provide the depth or thickness for the upper resilient section 30 of the inventive wrist rest assembly 10.

As assembled for use (FIG. 3), the layer of resilient material 42 is aligned with its bottom surface 46 on the top surface 34 of the base 32, and the layer of gel 52 is aligned with its bottom surface 56 generally adjacent the top surface 48 of the layer of resilient material 42. The lower liquid-impervious layer 50 is disposed between the layer of gel 52 and the layer of resilient material 42, while the upper liquid-imperious layer 60 is disposed between the layer of gel 52 and the outer cover 62. The outer cover 62 encloses the assembly and is joined at its periphery to the base 32, as at 63, to form a sealed chamber 64.

The layer of gel 52 is preferably formed from a stable elastomeric block copolymer gel similar to the gel described in U.S. Pat. No. 3,676,387 to Lindlof (which is incorporated herein by reference) and preferably is the gel described in Example No. 3 of British Patent No. GB 1,268,431 (which is incorporated herein by reference), except that the ratio of oil to block copolymer is in the range of 4 to 1 to 10 to 1 rather then being 5 to 1 as described in that Example No. 3. This is the same gel as used in the previously mentioned 3M Gel-Filled Wrist Rest, commercially available from Minnesota Mining and Manufacturing Company, St. Paul, Minn. Preferably, the layer of gel 52 is formed by longitudinally extruding the gel directly onto the lower liquid-impervious layer 50, and this assembly is then cut to length for further processing into individual wrist rest assemblies. The layer of gel 38 preferably has a thickness (preassembly) of between ¼ and ⅜ inch.

The liquid-impervious layers 50 and 60, which surround the layer of gel 52, are both flexible and liquid impermeable in order to prevent any oils in the layer of gel 52 from leaching through to the layer of resilient material 42 or to the outer cover 62. The upper layer 60 is also preferably puncture resistant. Materials contemplated for the liquid-impervious layers 50 and 60 include polyurethane and polyethylene, although it is not necessary that both layers be formed from the same material. In one preferred embodiment of the present invention, the liquid-impervious layers 50 and 60 are formed from 1.5 mil polyurethane films. The lower layer 50 does not need to be as flexible as the upper layer 60, and thus a thicker film (e.g., a 4 to 5 mil polyurethane film) may be used for the lower layer 50. Such layers 50 and 60, when wrapped about the layer of gel 52, cling together to form a relatively sealed envelope for the gel. In another embodiment, the layers 50 and 60 are affirmatively sealed (e.g., heat sealed), or otherwise bonded together to define a gel packet for further assembly into a wrist rest.

As mentioned, the gel material is rather dense, and a wrist rest with its cushioning and support material (i.e., upper resilient section 30) formed entirely from gel would be heavy and cumbersome. In the inventive wrist rest assembly, the layer of resilient material 42 is added to replace some of the gel layer. The layer of resilient material 42 is relatively lightweight, while still providing resiliency and tactile hardness to the wrist rest assembly 10. The layer of resilient material 42 may be formed from a sheet of nonwoven web, open-celled and closed-celled foam materials (e.g., urethane and polyethylene), and combinations thereof.

In preferred embodiments of the present invention, the layer of resilient material 42 is a polyester thermal set, lofty nonwoven pad formed from a web of 15 to 50 denier fibers. Typically, a thermal set, nonwoven web provides increased resiliency over a nonwoven web having its fibers bonded together by a binder, and thus is preferable for this application. The nonwoven pad provides a lightweight, resilient sheet which serves to displace some of the volume of the heavier gel but still supports the gel and provides, in combination with the gel, resiliency and wrist support comparable to a gel wrist rest of the same thickness and formed solely of gel. Nonwoven webs suitable for this application are disclosed and can be formed (without the abrasive additive steps) as described in Hayes U.S. Pat. No. 5,082,720 (which is incorporated by reference herein). One preferred embodiment for such a nonwoven web is a blend of 80% 50 denier conventional polyester fibers (12 crimps per 25 mm, 40 mm long) and 20% 25 denier bonding fibers commercially available from either Hoechst Celanese, Charlotte, N.C. (under the trade designation CELLBOND), or Kanematsu, a Japanese company, (under the trade designation MELTE fiber). Another preferred embodiment for such a nonwoven web is a blend of 75% 15 denier conventional polyester fibers, commercially available from Hoechst Celanese, Charlotte, N.C., and 25% 15 denier bonding fibers, commercially available from either Hoechst Celanese, Charlotte, N.C. (under the trade designation CELLBOND), or Kanematsu, a Japanese company (under the trade designation MELTE fiber).

The outer cover 62 has an outer surface 64 which is nonirritating to human skin, and which is flexible to conform to overlay the resilient upper section 30 without pleating or wrinkling. The smooth texture of the outer cover outer surface 64 does not abrade the skin of the user, is wear and stain resistant and does not pill with extended use. Further, the outer cover 62 is preferably puncture resistant and lightweight. Materials contemplated for the outer cover 62 included cotton, polyester, nylon or LYCRA knits, or blends thereof. In a preferred embodiment of the inventive wrist rest assembly, the outer layer 62 is formed from a 100% nylon 1×1 rib warp knit (0.4233 lb/sq. yd.), commercially available from Straus Knitting, Inc., St. Croix, Wis.

When assembled as seen in FIG. 3, the outer cover 62 and base 32 are bonded together along their respective edges (as at 63) to form the sealed chamber 64 therebetween. The layer of gel 52 and layer of resilient material 42 are thus enveloped and pressed together between the outer cover 62 and base 32. The lower liquid impervious layer 50 prevents seepage of gel into the layer of resilient material 42 (which, in the case of a nonwoven material, is a relatively open structure), while the upper liquid-impervious layer 60 prevents oils from the gel from contacting the outer cover 62. Preferably, the layer of gel 52 is wider (as illustrated in FIG. 4) and longer than the layer of resilient material 42 so that no resilient material contacts the outer cover 62. To a user touching any portion of the outer cover 62, the inventive wrist rest assembly thus has the feel and consistency of a gel-filled wrist rest.

The base 32 and outer cover 62 are secured together along their peripheral edges by suitable means, such as by convection, impulse or ultrasonic, heating, or by an adhesive or pressure sensitive adhesive. To facilitate such joinder by heat sealing techniques, the heat sealable film 38 is provided adjacent the top surface 34 of the base 32. Preferably, the film 38 is a 10 mil thick polyurethane sheet, but any thermoplastic material that features a low melting point and reasonable flow characteristics is adequate for this heat sealing purpose (e.g., also polyethylene or polypropylene). Peripheral portions of the upper and lower layers 50 and 60 may be included in the heat seal at 63, or they may be simply wrapped around the layer of gel 52 (as illustrated in FIG. 3).

Figure 5A:
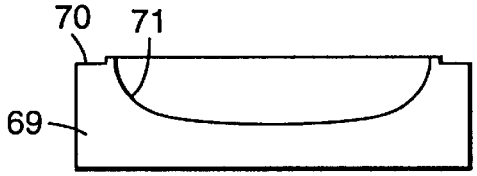
FIGS. 5*a*–5*f* illustrate schematically the operational steps involved in the assembly of the wrist rest assembly of the present invention.
Figure 5B:
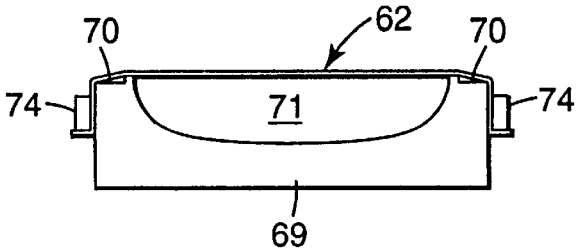
Figure 5C:
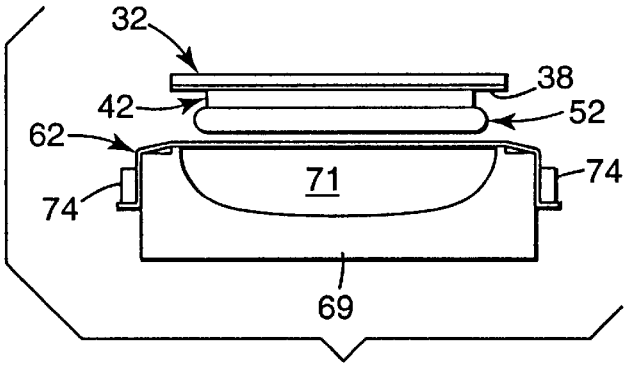

The assembly of the components shown in FIG. 4 into the wrist rest assembly 10 shown in FIG. 3 is schematically illustrated in FIGS. 5*a*–5*f*. The wrist rest assembly 10 is assembled in a fixture 69 which has an assembly face 70 and a cavity 71 defined thereon. The cavity 71 has the shape of a reverse image of the desired final product shape (i.e., the shape of upper resilient section 30), as shown in FIG. 5*a*. The material which will form the outer cover 62 is aligned over the assembly face 70 and cavity 71 and clamped about the fixture 69 by clamps 74 (FIG. 5*b*). The layer of gel 52, which has been profile extruded onto lower layer 50, cut to length and covered with upper layer 60, is placed on top of the outer cover 62 (see FIG. 5*c*). The upper layer 60 (on the top surface 54 of the layer of gel 52) is laid against an inner surface 76 of the outer cover 62 (see FIG. 3). The layer of resilient material 42 is then placed over the gel 52, with its top surface 44 against the lower layer 50 disposed about the layer of gel 52. The heat sealable film 38 is laid over the layer of resilient material 42 and then the base 32 is aligned over the heat sealable film 38, with the top surface 34 of the base 32 adjacent the bottom surface 46 of the layer of resilient material 42.

Figure 5D:
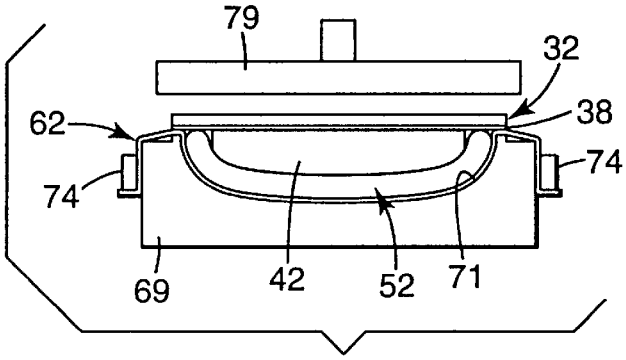

Once the wrist rest components have been so aligned relative to the fixture 69, a forming platen 79 is brought into engagement with the bottom surface 36 of the base 32 and urged toward the assembly face 71 of the fixture 69 (see FIG. 5*d*). The layers of gel and resilient material are thus pushed into the cavity 71 of the fixture 69, and the outer cover 62 stretches (without wrinkling or pleating) in all three x-y-z coordinates as necessary to mirror the shape of the cavity 71 while retaining the gel and resilient material layers therein.

Peripheral edges of the base 32 and outer cover 62 are pressed together, with the heat sealable film 38 disposed therebetween. The layer of gel 52 and layer of resilient material 42 are compressed or molded within the cavity 71 to generally assume the shapes (in lateral section) shown in FIG. 3. The layers are dimensioned so that the gel "flows" over and around the resilient material as the components are compressed and thus, after assembly, no resilient material is in direct contact with the outer cover 62. In a preferred embodiment, the platen 79 is an ultrasonic welding horn which, when activated, heats the peripheral edges of the component materials. The heat sealable film 38 melts and flows into the material of the outer cover 62 and into the base 32 itself to bond the base 32 and outer cover 62 together as at 63 in FIG. 3.

Figure 5E:
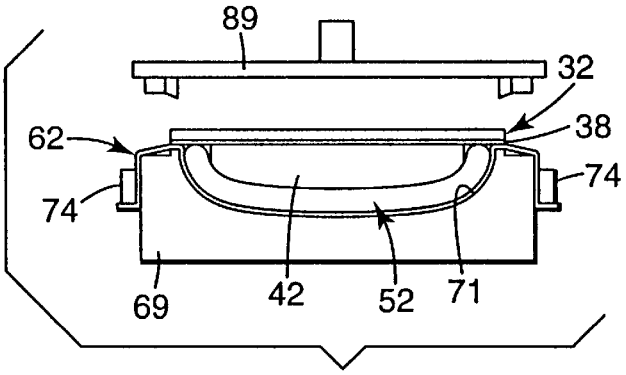
Figure 5F:
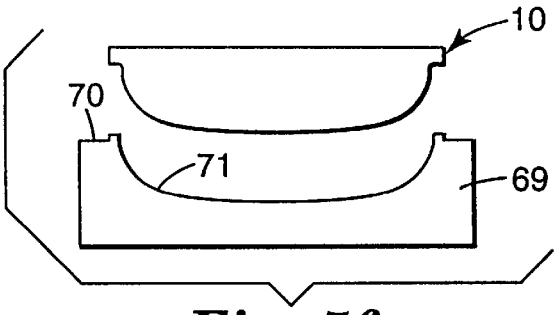

After suitable heating to effect bonding, the platen 79 is removed, and any excess base or outer cover material is then excised by a cutting die 89 which is urged against the assembly face 70 of the fixture 69 (see FIG. 5*e*). The finished wrist rest assembly 10 may then be removed from the fixture 69 (as shown in FIG. 5*f*), and the fixture 69 is ready to repeat the assembly process.

In an embodiment of the invention designed for use with a standard computer keyboard, the wrist rest assembly 10 has a length of about 19 inches, a width of about 3 inches and a height of between ¾ and 1 inch. The height of the wrist rest assembly causes the user's wrists to remain in their neutral position while manipulating the computer keyboard 20, mouse 22 or similar device. Additionally, the inventive wrist rest assembly 10, with the layer of resilient material 42, has a similar perceived tactile hardness and resiliency of an all gel wrist rest. Further, a wrist rest composed solely of gel (with the same dimensions as a wrist rest made according to the present invention) would weigh up to three times greater than the inventive wrist rest. The layer of resilient material 42 substantially decreases the overall weight of the wrist rest assembly 10 without a noticeable sacrifice in the resiliency, tactile hardness or wrist supporting performance of the device.

Although the present invention has been described with reference to preferred embodiments, workers skilled in the art will recognize that changes may be made in form and detail without departing from the spirit and scope of the invention. For example, a liquid-impervious outer cover would obviate the necessity for the upper liquid-impervious layer. In addition, the layer of gel may be extruded to a desired profile having, for example, thinner portions along its longitudinal edges to facilitate overlying the layer of resilient material upon assembly. Further, the base 32 may be sized just to support the upper resilient section 30 of the wrist rest assembly, or may have an additional base portion 90 (FIG. 2) adapted for supporting the device (e.g., mouse 22) to be operated by the user.

What is claimed is:

1. In a wrist rest assembly for use adjacent a device operated by a person's hands or fingers, such as a computer keyboard, lap-top or portable computer, computer mouse or other input device, wherein the wrist rest assembly has a base and a layer of resilient gel supported above the base, the improvement which comprises:

a layer of resilient material disposed between the base and at least a portion of the layer of gel to define, in combination with the layer of gel, a resilient wrist rest support structure supported from the base, and a flexible outer cover completely and permanently surrounding both the layer of resilient gel and the layer of resilient material.

2. The wrist rest assembly of claim 1 wherein the layer of resilient material is a lofty nonwoven pad.

3. The wrist rest assembly of claim 1 wherein the outer cover includes an outer layer defining a top outer surface of the wrist rest support of soft material for contact with a user's wrists.

4. The wrist rest assembly of claim 1, and further comprising:

a flexible liquid-impervious layer disposed between the outer cover and the layer of resilient gel.

5. The wrist rest assembly of claim 1 wherein the gel is a stable elastomeric block copolymer gel.

6. The wrist rest assembly of claim 1, and further comprising:

a flexible liquid-impervious layer disposed between the layer of resilient gel and the layer of resilient material.

7. The wrist rest assembly of claim 1 wherein the base is flexible.

8. The wrist rest assembly of claim 1 wherein the base has a first portion for supporting the resilient wrist rest support structure thereon and a second portion for supporting the device to be operated by the user.

9. The wrist rest assembly of claim 1 wherein the base has a bottom outer surface which has nonskid characteristics.

10. The wrist rest assembly of claim 1 wherein the layer of resilient material has a lower density than the layer of resilient gel.

11. The wrist rest assembly of claim 1 wherein the layer of resilient material is selected from the group consisting of nonwoven webs, foam materials, or combinations thereof.

12. The wrist rest assembly of claim 1, and further comprising:

a liquid-impervious envelope covering the layer of resilient gel.

13. In a wrist rest assembly for use adjacent a device operated by a person's hands or fingers, such as a computer keyboard, lap-top or portable computer, computer mouse or other input device, wherein the wrist rest assembly has a layer of resilient gel retained in a sealed chamber which is defined by a flexible upper wall, a lower wall and side walls disposed therebetween, the improvement which comprises:

a layer of resilient material disposed in the chamber between its lower wall and the layer of gel.

14. The wrist rest assembly of claim 13, and further comprising:

a flexible outer cover which defines a portion of the sealed chamber.

15. The wrist rest assembly of claim 14 wherein the flexible outer cover includes an outer layer of soft material for contact with a user's wrists.

16. The wrist rest assembly of claim 14, and further comprising:

a flexible liquid-impervious layer disposed between the outer cover and the layer of resilient gel.

17. The wrist rest assembly of claim 13, and further comprising:

a liquid-impervious layer about the layer of resilient gel retained in the sealed chamber.

18. The wrist rest assembly of claim 13, and further comprising:

a flexible liquid-impervious layer disposed between the layer of resilient gel and the layer of resilient material.

19. The wrist rest assembly of claim 13 wherein the gel is a stable elastomeric block copolymer gel.

20. The wrist rest assembly of claim 13 wherein the layer of resilient material is selected from the group consisting of nonwoven, woven or foam materials, or combinations thereof.

21. The wrist rest assembly of claim 13 wherein the layer of resilient material has a lower density than the layer of resilient gel.

22. The wrist rest assembly of claim 13 wherein the lower wall of the sealed chamber is defined by a base member.

23. The wrist rest assembly of claim 22 wherein the base member is flexible.

24. The wrist rest assembly of claim 22 wherein the base member has a bottom outer surface which has nonskid characteristics.

25. The wrist rest assembly of claim 22 wherein the base member has a first portion for supporting the resilient wrist rest support structure thereon and a second portion for supporting the device to be operated by the user.

26. The wrist rest assembly of claim 13, and further comprising:

a liquid-impervious envelope covering the layer of resilient gel.

27. The wrist rest assembly of claim 13 wherein the layer of resilient material is a lofty nonwoven pad.

28. A wrist rest assembly for use adjacent a device operated by a person's hands or fingers, such as a computer keyboard, lap-top or notebook computer, computer mouse or other input device, the wrist rest assembly comprising:

a base having top and bottom opposed surfaces and a periphery;

a layer of resilient material having top and bottom surfaces, the layer of resilient material aligned with its bottom surface on the top surface of the base;

a layer of gel having top and bottom surfaces and opposite longitudinally extending edges, the layer of gel aligned with at least a portion of its bottom surface on the top surface of the layer of resilient material, the layers of resilient material and gel having a sufficient width between edges and combined thickness, between the bottom surface of the layer of resilient material and the top surface of the layer of gel, to support a user's wrists on the top surface of the layer of gel and afford significant motion, in a horizontal plane, of the top surface of the layer of gel with the supported wrists relative to the bottom surface of the layer of resilient material; and a flexible outer cover extending about both the layers of gel and resilient material and sealed to the periphery of the base to permanently secure the layers of gel and resilient material relative to the base.

29. A multilayered resilient wrist rest assembly comprises:

an outer flexible cover sheet having a peripheral edge;

a layer of gel disposed under the cover sheet;

a discrete layer of resilient support material disposed under the layer of gel; and a base structure, the peripheral edge of the cover sheet being bonded to the base structure to retain the layers of gel and resilient material therebetween.

* * * * *